US005979976A

United States Patent [19]

Ferencik

[11] Patent Number: 5,979,976

[45] Date of Patent: Nov. 9, 1999

[54] FOLDABLE SUPPORT STRUCTURE

[76] Inventor: Mark J. Ferencik, 2550-L Glenwood Ave., Raleigh, N.C. 27608

[21] Appl. No.: 09/058,721

[22] Filed: Apr. 10, 1998

[51] Int. Cl.[6] ..... A47C 4/00; A47C 5/10

[52] U.S. Cl. ..... 297/16.1; 297/17; 297/51; 297/53; 297/445.1; 297/452.2; 135/125; 108/115; 16/371

[58] Field of Search ..... 297/16.1, 17, 19, 297/51, 53, 54, 445.1, 452.2, 40; 135/125, 126; 248/188.6; 108/115, 131; 16/366, 371, 374, 377

[56] References Cited

U.S. PATENT DOCUMENTS

| | | | |
|---|---|---|---|
| 446,249 | 2/1891 | Craig | 297/51 |
| 887,967 | 5/1908 | Schermerhorn | 108/115 |
| 3,279,846 | 10/1966 | Morosini | 297/19 |
| 4,881,299 | 11/1989 | Young et al. | 16/371 |
| 5,078,056 | 1/1992 | McCauley | 108/115 |
| 5,435,620 | 7/1995 | Cheng | 297/16.1 X |
| 5,507,719 | 4/1996 | Freeman | 16/371 X |
| 5,676,168 | 10/1997 | Price | 135/125 X |

FOREIGN PATENT DOCUMENTS

| | | | |
|---|---|---|---|
| 820029 | 10/1937 | France | 297/16.1 |
| 1425235 | 12/1965 | France | 297/16.1 |

*Primary Examiner*—Peter M. Cuomo
*Assistant Examiner*—Rodney B. White
*Attorney, Agent, or Firm*—Olive & Olive

[57] ABSTRACT

A foldable support structure having at least three interconnected rigid annular rings. The first ring is formed for service as a base. A second ring is formed for service as a load bearing support above the base. A third ring is formed for service as a connector to connect the first and second rings and to support the second ring above the first ring. A first releasable load-bearing hinge is mounted to hingedly join adjacent portions of the first and third rings. A second releasable load bearing hinge is mounted to hingedly join adjacent portions of the second and third rings, wherein the hingedly joined adjacent portions of the first and third rings being oppositely disposed from the hingedly joined adjacent portions of the second and third rings.

11 Claims, 7 Drawing Sheets

FOLDABLE SUPPORT STRUCTURE

FIELD OF INVENTION

This invention is directed to a portable folding support structure and particularly to a folding support structure useful as a chair that is strong when erected, easily folded, and collapsible into a form that is conveniently portable.

BACKGROUND OF INVENTION

Folding support structures are known. For example, some support structures are in the form of beach or pool chairs that can be conveniently carried to the beach, pool or other recreational location so they can be easily erected to provide comfortable support when sitting. Most conventional portable folding chairs are made of rattan, wood, plastic, metal, etc. Traditional foldable support structures such as chairs and portable tables often utilize inclined front and rear support legs supporting the seat or tabletop. The legs intersect such that when viewed from the side an "X" shape is formed. The legs pivot around their intersection points to allow the structure to fold and unfold. This type of foldable support structures uses complex and often heavy hinges and leg braces and sometimes require bulky and unsightly leg spanning structures, all of which may not provide strong support for the foldable support structure in the erected position and certainly makes the portable foldable support structure relatively heavy for carrying.

For the foregoing reasons, there is a need for a portable foldable support structure that uses light, strong, and unobtrusive hinges which also act as leg brace structures to impart rigidity and strength to the entire structure when in use and that can be easily and quickly erected, released and folded up into a form to facilitate convenient handling and storage in relatively small or narrow spaces. Therefore, it would be desirable to provide a portable folding support structure constructed with strong rigid hinge and brace structures such that when in the erect position they would be subject to easy and quick release for folding into a compact form convenient for handling and storage into a small space by stacking.

SUMMARY

This invention relates to a portable folding support structure having a series of annular interconnected, rigid, rings made of stiff metal or other material suited to the load being supported. A first ring serves as a base for the support structure. A second ring is positioned to serve as a load bearing support above and substantially parallel to the first ring when erected in its support stance. A third ring is used to connect the first and second rings together. The third ring includes a pair of opposed relatively short integrally joined, linear tubular portions. The first short, rigid, linear tubular portion of the third tubular ring is located proximate and substantially in parallel with the rigid, linear, tubular portion of the first tubular ring and an opposite second short integrally joined, linear rigid portion of the third tubular ring. The second linear rigid tubular portion is located proximate and substantially parallel to a first short integrally joined, substantially linear rigid tubular portion of the second tubular ring. A pair of hinges are used to pivotally join the first tubular ring first portion and the third tubular ring first tubular portion, and the third tubular ring second portion to the second tubular ring first portion. The hinges are releasable and lockable in selected positions. Releasing and locking the hinges enables the first ring, when serving as a base and supported on a base surface, to be positioned so as to fixedly support the second ring in a position above and substantially parallel to the first ring. The third ring can be positioned in an angular position extending between the respective joins to enable the first tubular ring to be positioned so as to be folded and rest proximate the second and third rings. The second ring is provided with a structure thereon to serve as a support surface. These and other features, aspects, and advantages of the present invention will become better understood with regard to the following description, appended claims, and accompanying drawings.

DESCRIPTION OF THE PREFERRED EMBODIMENT

Figure 1:
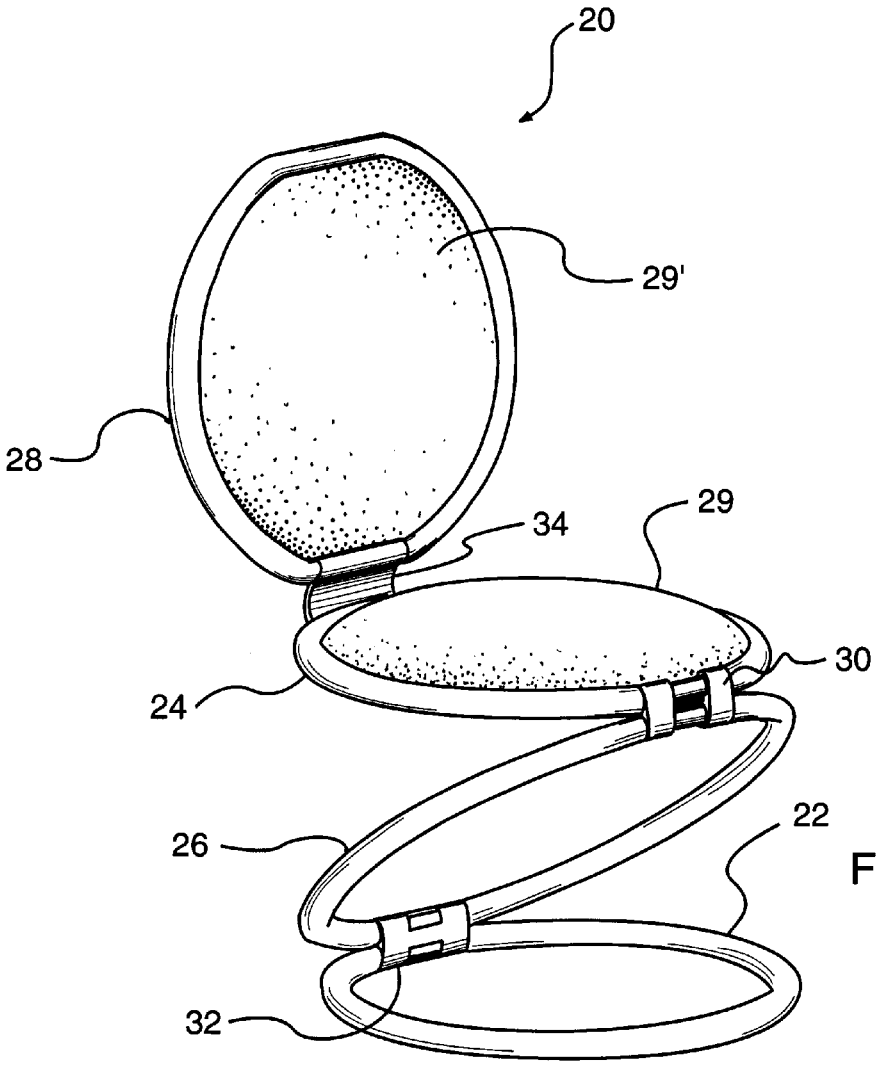
FIG. 1 shows a perspective view of the foldable support structure of the invention in the erected position.

Showing the preferred embodiment, FIGS. 1 through 7 illustrate the portable foldable support structure 20 of this invention, in particular, a folding chair, in variety of views. However, it is understood that the foldable support structure 20 of this invention could as well apply to a bench, table, or any other support structure that benefits from also being foldable and easily portable, and that such embodiments would be apparent to those skilled in the art.

Referring still to FIGS. 1–7, the basic components of the foldable support structure 20 include a series of annular rigid rings. A first substantially annular tubular ring 22 serves as a base for the foldable support structure 20 of the invention. A second substantially annular rigid tubular ring 24 is positioned to provide a load bearing support substantially parallel and above first tubular ring 22. A third substantially annular rigid tubular ring 26 connects first tubular ring 22 and second tubular ring together 24. The foldable support structure 20 further includes back support 28 connected to the back portion of second tubular ring 24. Support cushions 29, 29' are attached to annular rings 24, 28 to form a cushioned support platform of second tubular ring 24 for bearing a heavy load, for example, a seated person, and to form a back support to support the weight of a seated person leaning back against support cushion 29'. Support cushions 29, 29' may be made of any material known in the art, as for example, plastic, wood, metal, and the like to form basic support platforms.

Referring still to FIGS. 1–7, a first hinge 32 hingedly connects first annular ring 22 to third annular ring 26. A second hinge 30 hingedly connects second annular ring 24 to third annular ring at a position on third annular ring opposed to the position of third annular ring first hinge 32 connection. Third hinge 34 hingedly connects back support 28 to second annular ring 24 at a position on said second annular ring 24 opposed to said position of second annular ring second hinge 30 connection. In the erect position, first and second hinges contain stop plates (described in detail below) such that first, second, and third annular rings, 22, 24, and 26 do not collapse together when a load is placed on second annular ring 24. FIGS. 1–7 make it immediately evident that no support leg extends from or is connected to the back portion of second annular ring 24, and that the only support structure (the third annular ring 26) is attached to the a small section at the front of second annular ring 24 and to a small section at the back of first annular ring 22. In essence, the foldable support structure of the invention 20 is a foldable, stable, single legged chair.

Figure 2:
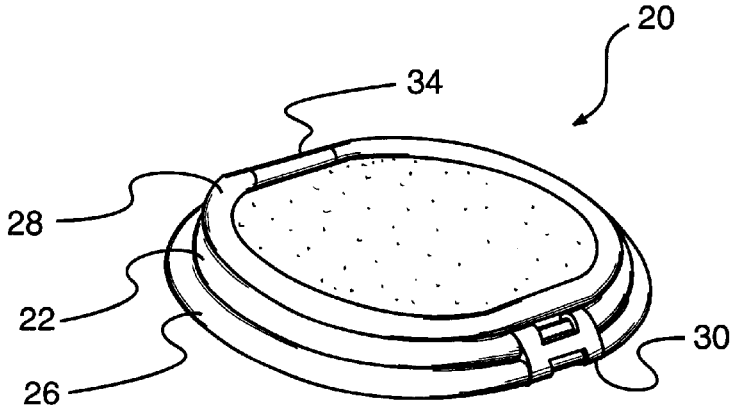
FIG. 2 shows a perspective view of the foldable support structure of the invention in the folded position.
Figure 3:
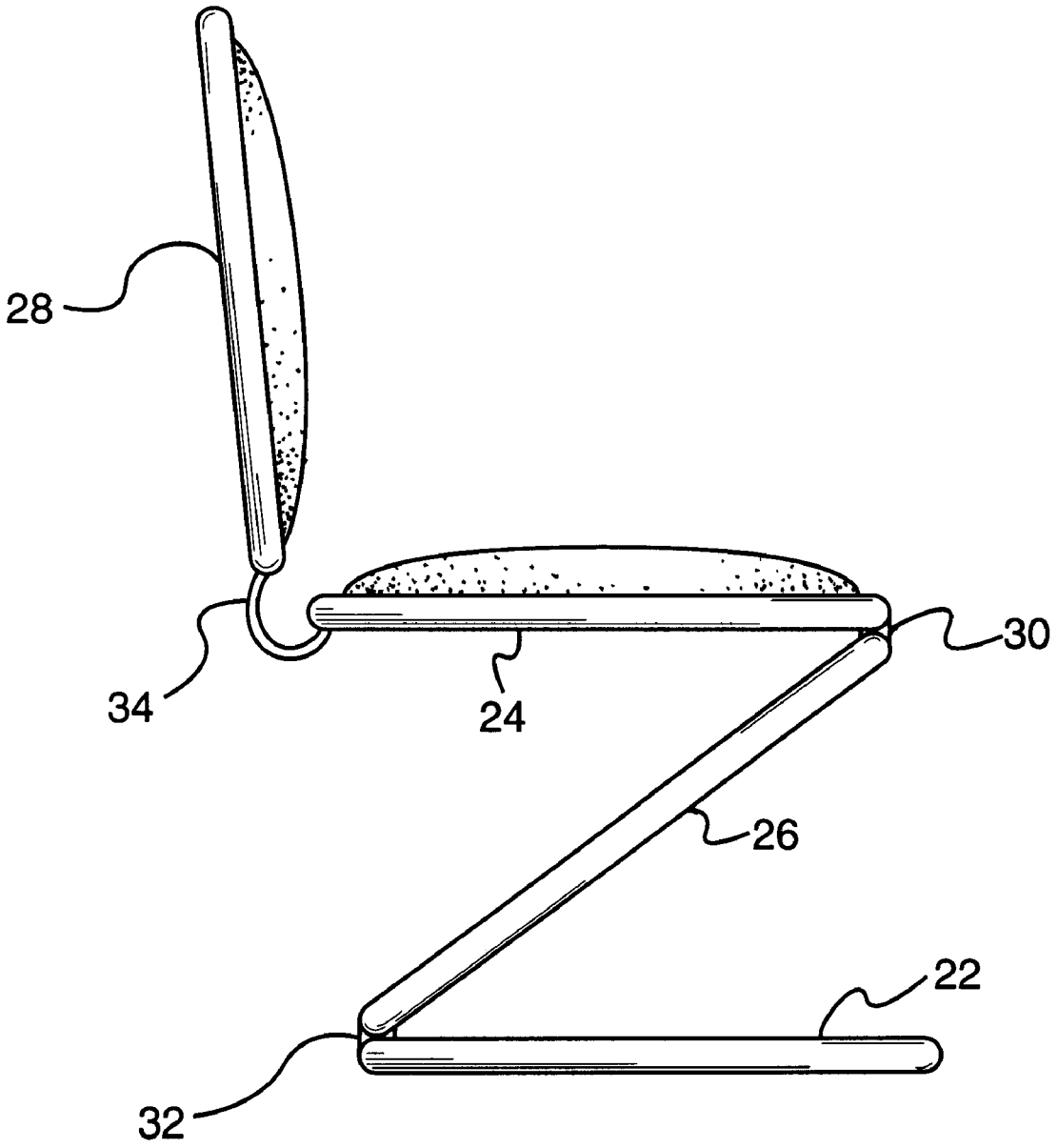
FIG. 3 shows a side elevation view of the foldable support structure of the invention in the erected position.
Figure 4:
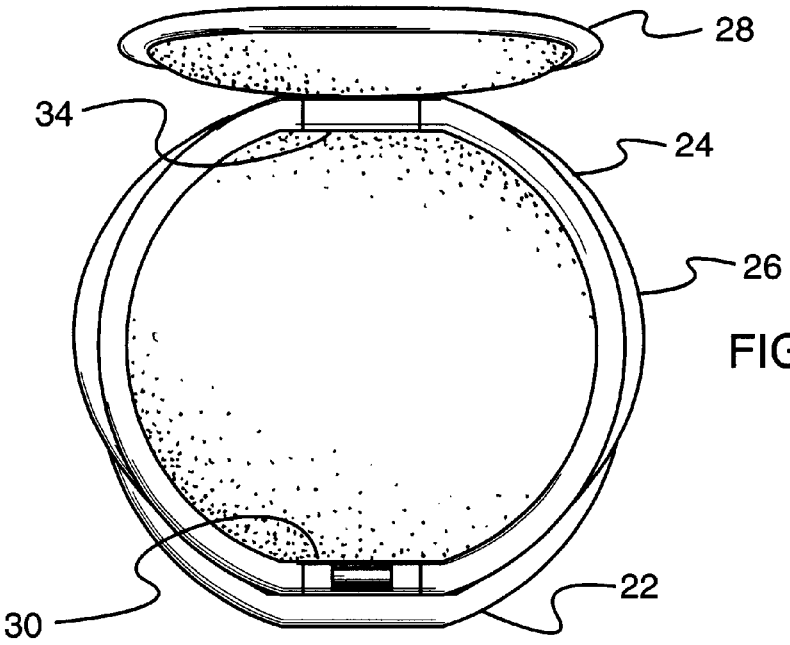
FIG. 4 shows a top view of the foldable support structure of the invention in the erected position.
Figure 5:
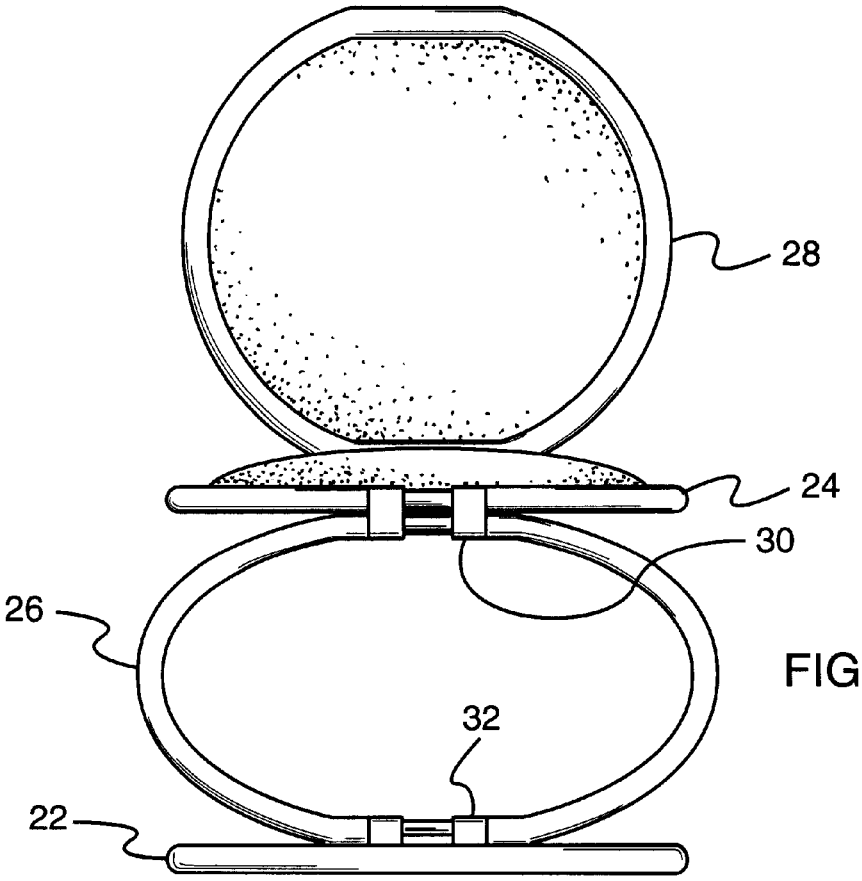
FIG. 5 shows a front elevation view of the foldable support structure of the invention in the erected position.
Figure 6:
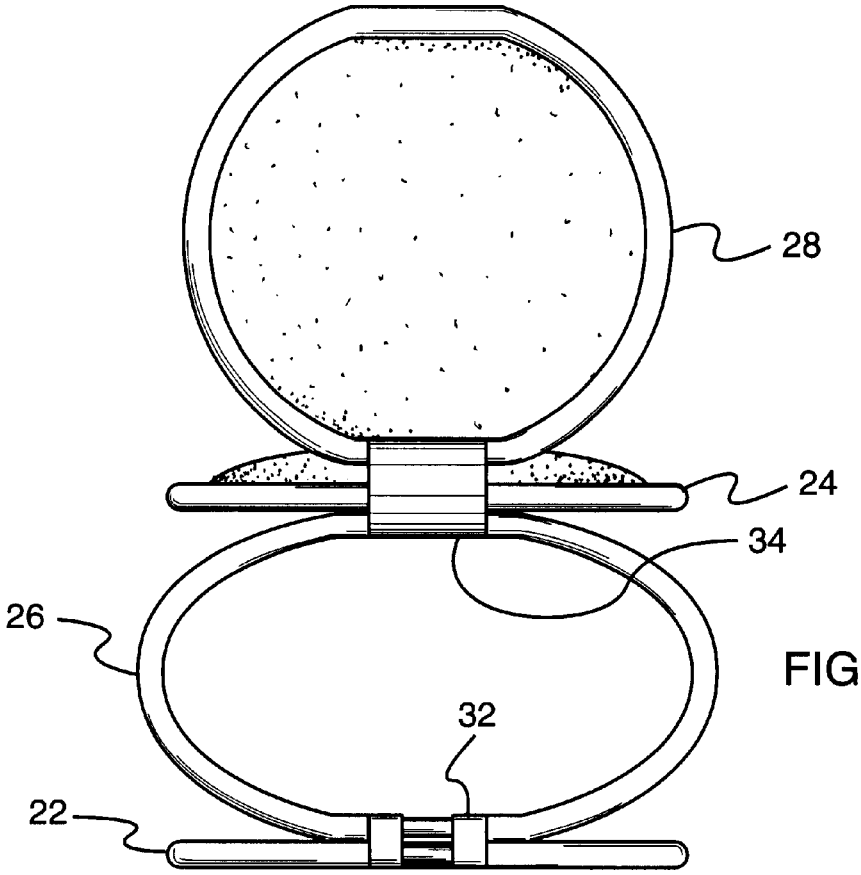
FIG. 6 shows a back elevation view of the foldable support structure of the invention in the erected position.
Figure 7:
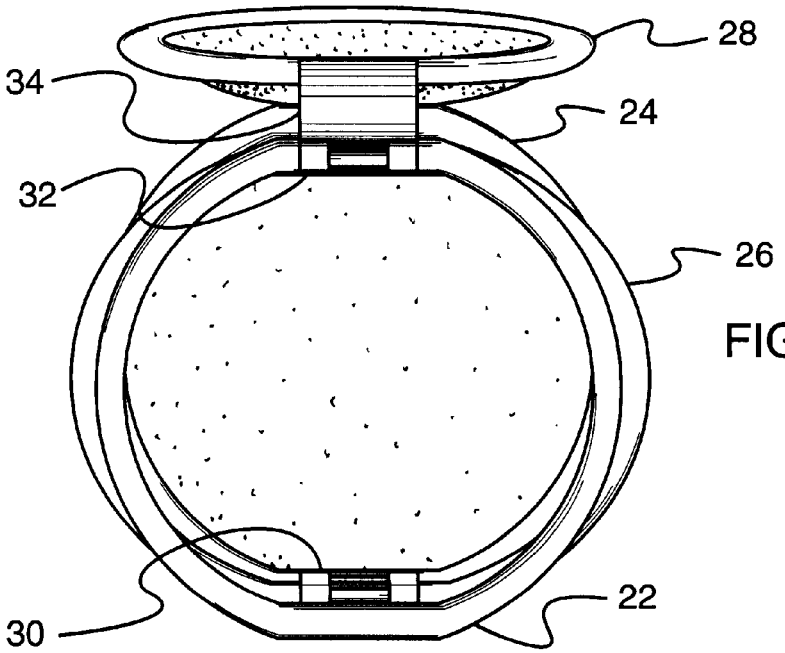
FIG. 7 shows a bottom view of the foldable support structure of the invention in the erected position.
Figure 8C:
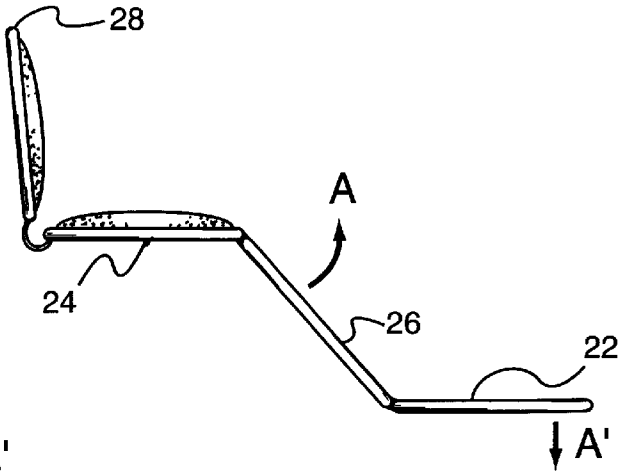
FIGS. 8A–8G illustrate side views of the support structure demonstrating through sequential positions the mechanics of bringing a foldable support structure of the invention from its erect position to its fully folded position.
Figure 8B:
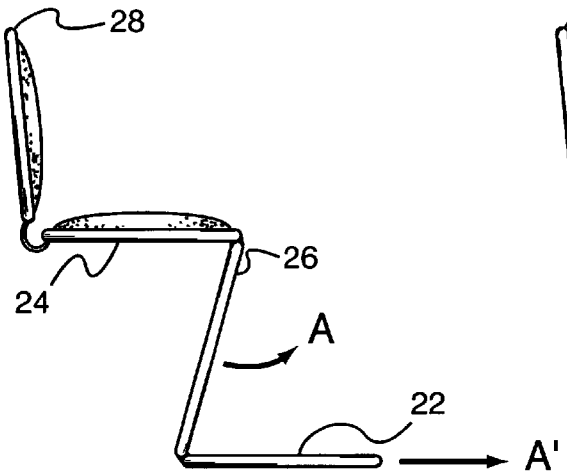
Figure 8A:
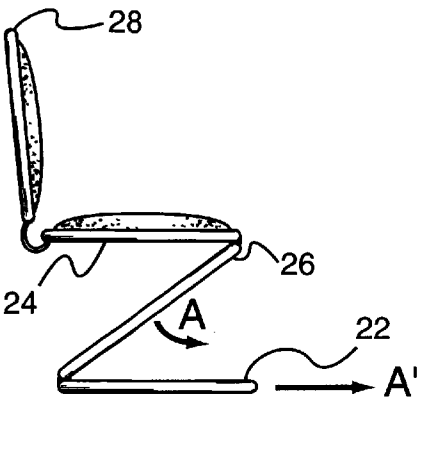
Figure 8G:
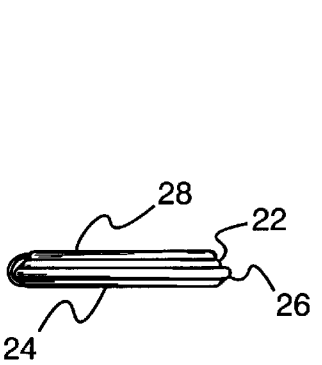
Figure 8F:
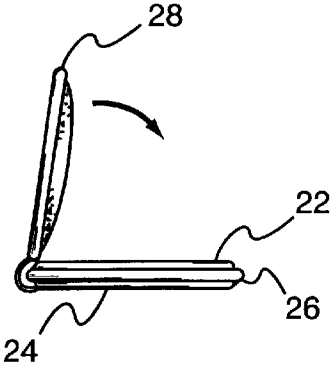
Figure 8E:
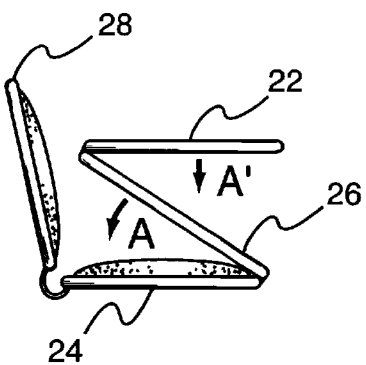
Figure 8D:
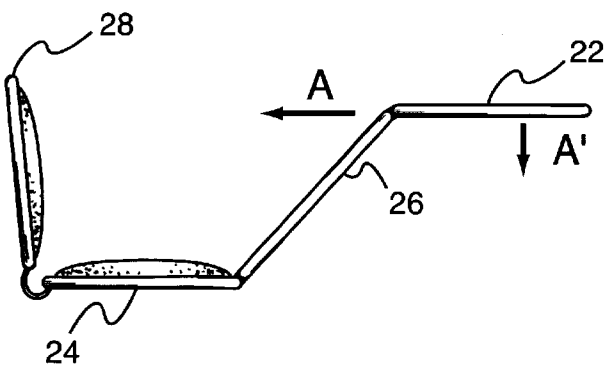

FIGS. 8A–8G illustrates through sequential positions the mechanics of bringing the foldable support structure 20 from its erect position as shown in FIG. 8A to its fully folded position as shown in FIG. 8B. Hinge 30 (shown in FIGS. 1–7) allows second annular ring 24 and third annular ring 26 to rotate approximately a combined 200 degrees, essentially in the direction of arrow A such that in the fully folded position as shown in FIG. 8G, third annular ring is adjacent and residing upon second annular ring. Hinge 32 allows first annular ring 22 and third annular ring 26 to rotate in a direction opposite the approximate 200 degree rotation of second and third annular rings 24, 26 as illustrated by arrow A', such that in the fully folded position annular ring 22 is adjacent and resides upon annular ring 26. In the preferred embodiment, the diameters of first, second, and third annular rings 22, 24, and 26 are approximately 16.5, 16.5 and 18.5 inches, respectively. The respective diameters of annular rings 22, 24, and 26 allow device to fold into a compact shape as shown in FIGS. 2 and 8G, and also allow a plurality of foldable support structures 20 to easily stack on top of one another.

While the four ring-like, rigid, tubular members used in constructing the foldable support structure of the present invention are all depicted as being substantially annular or circular in form, it should be appreciated that such members could assume a square, rectangular or other shape suited to the invention. Thus, the term "annular" as used in the claims is intended to encompass ring-like members of circular form as well as of square, rectangular or other form suited to the invention. In addition, tubular members could be solid, as well as hollow.

In a broad sense, the foldable support structure can be expressed as comprising:

(a) a first substantially rigid tube defining in a first plane a first space surrounded by said first tube and formed for service as a base;

(b) a second substantially rigid tube defining in a second plane a second space surrounded by said second tube and formed for service as a load bearing support above said base;

(c) a third substantially rigid tube defining in a third plane a third space surrounded by said third tube and formed for service as a connector to connect said first and second tubes and to support said second tube above said first tube;

(d) a first releasable lockable hinge mounted to hingedly join adjacent portions of said first and third tubes;

(e) a second releasable lockable hinge mounted to hingedly join adjacent portions of said second and third tubes; and (f) said hingedly joined adjacent portions of said first and third tubes being oppositely disposed from the hingedly joined adjacent portions of said second and third tubes.

In summary, first tube when acting as a base and supported on a base surface is enabled to either fixedly support by means of said third tube said second tube in a position above and substantially parallel to said first tube with said first hinge in a first position or when said first tube is not acting as a base and with said first hinge in a second position to be folded to rest adjacent said second and third tubes in corresponding folded positions.

Hinges 30, 32 of the present invention are identical. Thus, the description below of the hinge and their interconnected rotatable annular rings of the present invention is applicable to either hinge 30, 32, and thus will be discussed in detail only once. In summary, each annular ring 22 and 24 is provided with a relatively short integrally joined, substantially linear, rigid tubular portion. Third annular ring 26 has an opposed pair of such linear, rigid, tubular portions. A first tubular portion of the third annular ring 26 is adjacent the rigid, tubular portion of first annular ring 22 and both are rotatably received within hinge 32. The second tubular portion of the third annular ring 26 is adjacent to the rigid tubular portion of second annular ring 24 and both are rotatably received within hinge 30.

Figure 9:
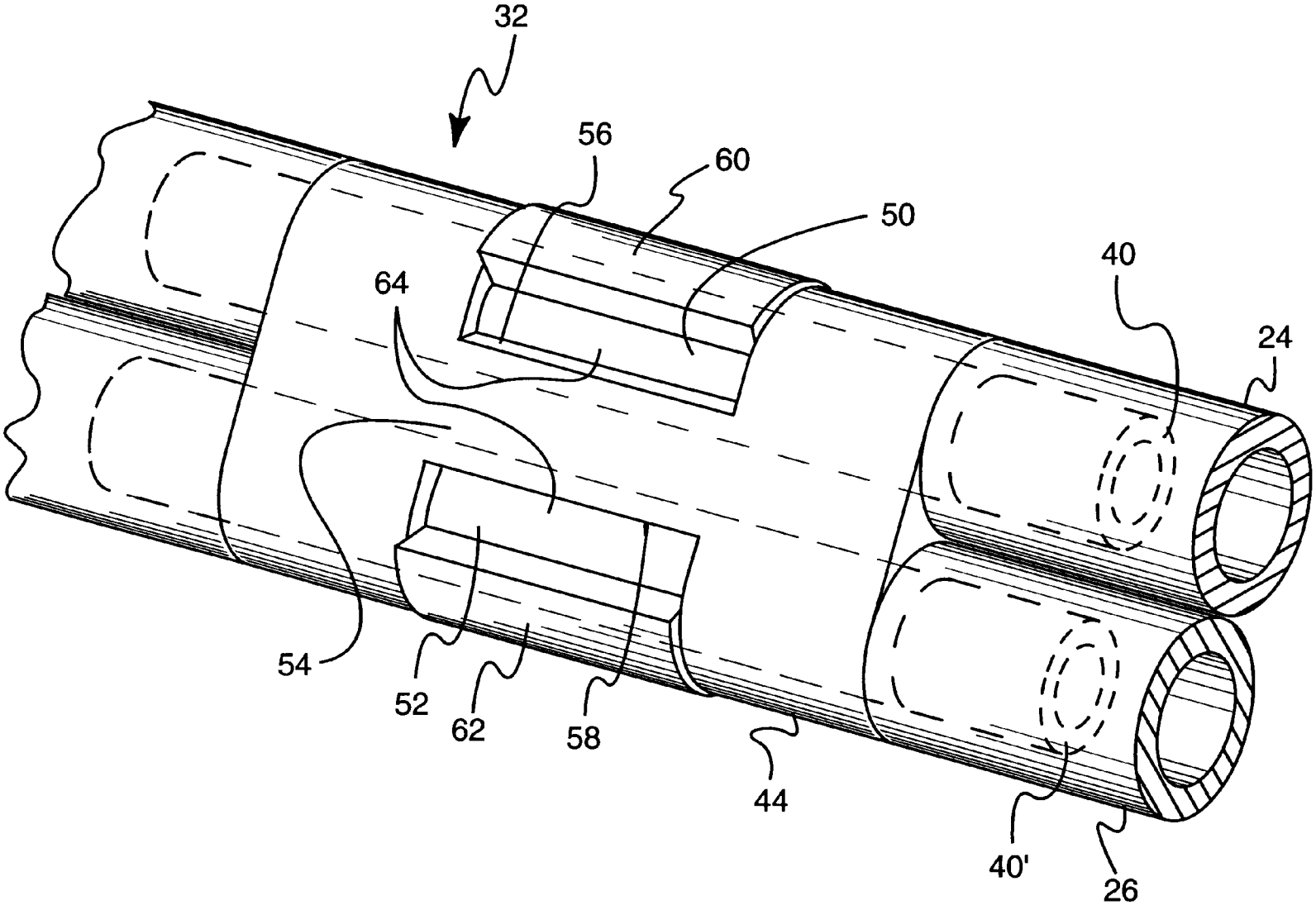
FIG. 9 shows a partial sectional view of the hinge mechanism of the invention.

Referring now to FIG. 9, we now describe the hinge of the present invention in more detail. By way of example, we will describe hinge 32. The third annular ring 26 is provided with a relatively short integrally joined, substantially linear, rigid, tubular portion 40'. The short integrally joined portion 40' of the third annular ring 26 is located proximate and substantially parallel to a second relatively short, integrally joined, substantially linear, rigid, tubular portion 40 of the second annular ring 24. First hinge 32 is used to pivotally join the substantially linear, rigid, tubular portion 40 and the second substantially linear, rigid, tubular portion 40'. Tubular portions 40, 40' rotate inside hinge 32. Annular rings 26 and 24 are permanently attached to the linear rigid tubular portions 40, 40', respectively, so that when annular rings 26, 24 rotate, linear rigid tubular portions 40, 40' rotate within hinge 32 correspondingly. It is understood that the rigid tubular portions could be integrally formed from rings 26, 24 and not be of separate materials permanently attached to their respective rings 26, 24 by methods well known in the art. Hinge 32 (as well as the identical hinge 30) includes means associated therewith to release and lock the hinges in selected positions, as described in detail below. Hinges 30, 32 are specially constructed to enable easy releasing and locking of the hinges. Thus, in a locked load bearing position, first tubular ring 22 when serving as a base and supported on a base surface to be positioned so as to fixedly support the second ring 24 in a position above and substantially parallel to the first tubular ring 22. In addition, the third tubular ring 26 can be positioned in an angular load bearing position extending between the respective joins.

Figure 10:
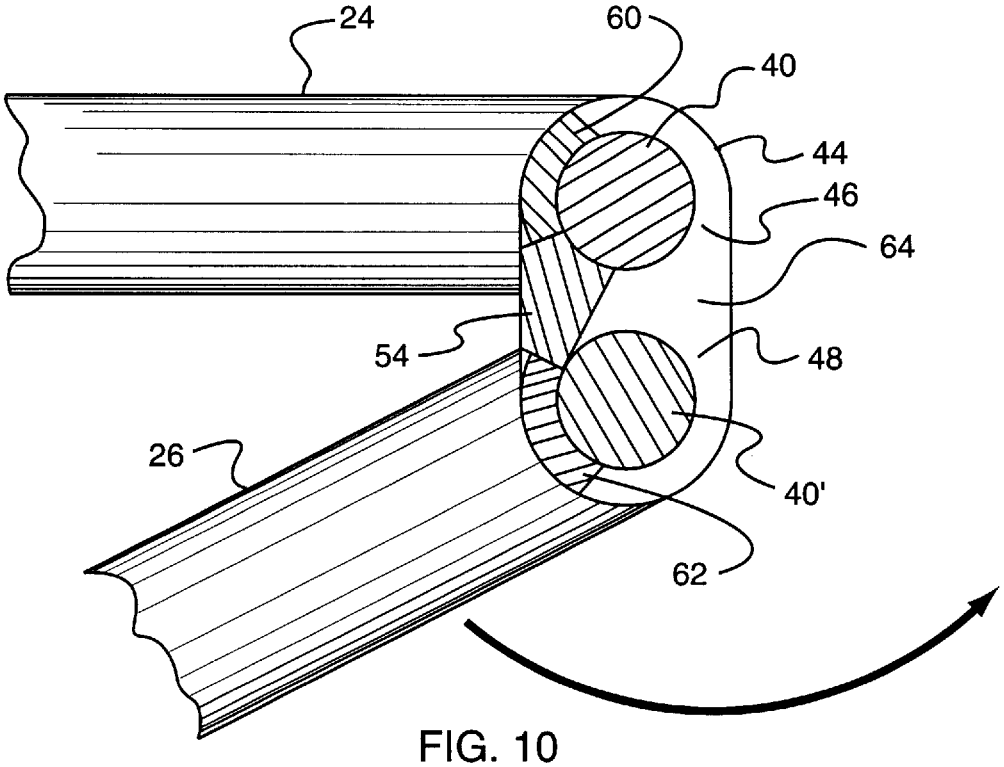
FIGS. 10A and 10B show a cross section of the hinge mechanism and tubular ring structures taken along 10—10 as shown in FIG. 9, illustrating the present invention's hinge mechanism position when the foldable support structure is in its erect position (FIG. 10A) and further shows the arrow indicating the movement of the support structure first and third rings to bring the support structure from erect position to its folded position (FIG. 10B).
Figure 11:
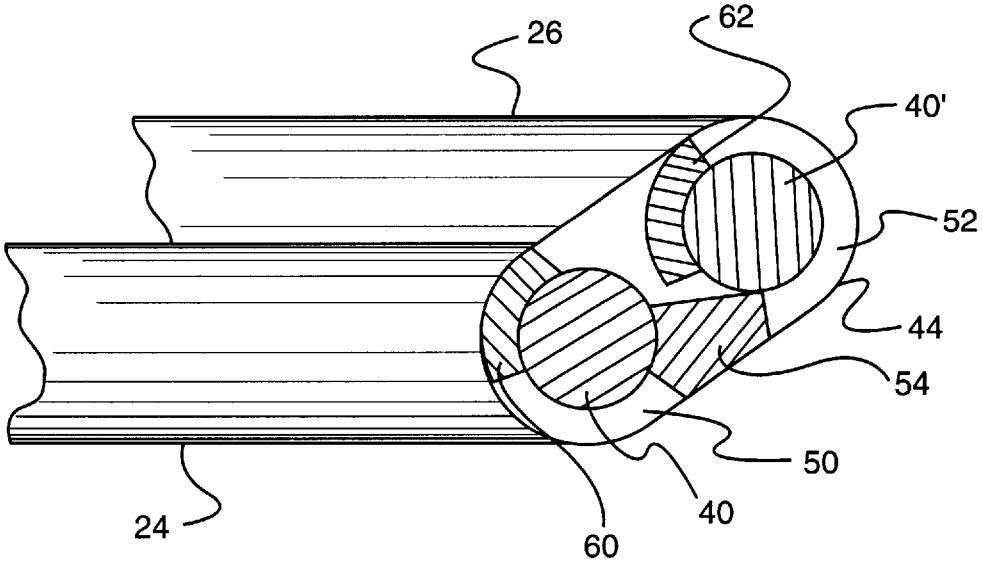
FIG. 11 shows the hinge in a completely unlocked and folded condition.

Referring now to FIGS. 9–11, hinge 30 is comprised of a hinge coupler or body 44. The hinge coupler forms two adjacent tubes, an upper tube portion 46 and a lower tube portion 48 as shown in FIGS. 10 and 11. Hinge coupler 44 upper tube portion 46 and lower tube portion 48 rotatably receive linear, rigid, tubular portions 40, 40' of annular rings 24, 26, respectively. Hinge coupler 44 has an outer diameter the same as the outer diameter of annular ring 24, 26, and the outer opposed surfaces of hinge 32 are substantially flat. Thus, hinge 32 (and hinge 30) is unobtrusive. As shown in FIG. 9, linear rigid tubular portions 40 and 40' are rotatably received within upper and lower portions 46, 48, respectively, and extend a distance beyond each end of hinge 32 to permanently attach to opposed ends of second and third annular rings, 24, 26, respectively, and are essentially parallel and located in a horizontal plane. The diameter center for upper and lower portions 46, 48 coincide with the diameter center for the linear rigid tubular portions 40, 40', respectively.

Referring still to FIGS. 9–11, hinge coupler includes a centrally located continues partially circumferential slot 64 (FIGS. 10, 11) through which move rotating stop plates 60, 62 therein. As shown in FIG. 9, when hinge 32 is in a near locked position, a first window 50 is formed that may, for example, take the form of a rectangular slot and a second window 52 is likewise formed that may also take the form of a rectangular slot. The first and second windows 50, 52 are separated by a hinge brace 54 having an upper stop surface 56 and a lower stop surface 58. The upper stop surface 56 defines a bottom ridge of first window 50 and the lower stop surface 58 defines an upper ridge of second window 52.

Continuous slot 64 is formed to receive stop plates 60, 62. Stop plates 60, 62 may, for example, be formed of relatively narrow curved metal plate material, and are permanently secured, by welding, or by other known methods known in the art, or are otherwise integral to linear rigid tubular portions 40, 40' respectively. Thus, when annular rings 24 and 26 rotate causing rigid tubular portions 40 and 40' to rotate, stop plates 60 and 62 also rotate within continuous slot 64. Stop plates 60, 62 move freely within continues slot 64, which serves as a guide for the plates when annular rings, in this case annular rings 24, 26 are moved from one position to another.

Single hinge 32 by interaction of brace 54 with stop plates 60, 62 can essentially lock annular rings 24, 26 into a fixed load bearing angle (as shown in FIGS. 1–7). By way of further explanation, referring to FIGS. 9–11, upper brace surface 56 and lower brace surface 58 act as a bracing or stopping device for the stop plates 60, 62. Thus, when stop plates 60, 62 rotate to the locked position they come into contact with upper and lower brace surfaces 56, 58, respectively, thereby closing windows 50, 52 as shown in FIG. 10. As shown in FIG. 10, the hinge in its locked position where stop plates 60 and 62 are pressing against brace 54, which essentially locks annular rings 24 and 26 at a fixed angle under weight bearing conditions. FIG. 11 shows the hinge in a completely unlocked and folded condition. Annular ring 26 has rotated around to reside upon annular ring 24. Windows 50, 52 have appeared due to rotation of stop plates 60, 62 away from brace 54, which is no longer bearing weight.

As already stated, the above description of hinge 32 applies equally to the structure and operation of hinge 30. The principal function of the hinges 30, 32 is for each to facilitate rotation of two rings about their axis. Hinges 30, 32 are capable of supporting a 300 lb. load set at a distance of about 16 inches from the hinge center. However, using stronger and/or larger hinges, as well as stronger and/or larger annular rings, the foldable support structure of the present invention could support loads that exceed 300 lbs. In addition, it is within the scope of the present invention to strengthen the hinge of the present invention, such that it would support such foldable support structures as large dinner tables, desktops, coffee tables and the like. The hinge could be lengthened to take into account the larger loads, and could include two or more continuous slots, two or more continuous braces, and corresponding stop plates within one hinge.

Backrest 28 is connected to annular ring 24 by hinge 34. Hinge 34, like hinges 30 and 32 have two pivot points. Hinge 34 allows back rest 28 to tilt-back when leaned against to provide sitting comfort, and to allow hinge 32 and associated annular first and third rings to pass by during the folding and unfolding process. Hinge 34 does not need to bear substantial weight and there are a number of hinge structures known in the art that would allow for rotation about both pivot points. In one embodiment, hinge 34 contains two coil springs; one spring for each rotator. The coil springs would limit the flexibility of the range of tilt-back.

While the invention has been particularly shown and described with reference to a preferred embodiment, it will be understood by those skilled in the art that various changes in form and detail may be made therein without departing from the spirit and scope of the invention.

I claim:

1. A foldable support structure, comprising:

(a) a substantially annular rigid first ring providing a base;

(b) a substantially annular rigid second ring providing a load bearing support above said base;

(c) a substantially annular rigid third ring serving to connect said first and second rings and having an integrally joined and substantially rigid first portion thereof located proximate and substantially parallel to an integrally joined substantially linear rigid first portion of said first annular ring and an opposite integrally joined substantially rigid second portion located proximate and substantially parallel to a relatively short integrally joined substantially rigid first portion of said second annular ring;

(d) a pair of first and second hinges, the first of which is mounted to hingedly join said first and third annular ring first portions and the second of which is mounted to hingedly join said third ring second portion to said second ring first portion and including means associated with each of said hinges to releasably lock said hinges in selected positions, thereby enabling said first ring, when acting as a base and supported on a base supporting surface, to be positioned so as to fixedly support said ring in a position above and substantially parallel to said first ring and said third ring to be positioned so as to be held in an angular position extending between the respective said hinges; and (e) means joined to said second ring providing a support surface thereon.

2. A foldable support structure as claimed in claim 1 including:

(a) a substantially annular rigid fourth ring having an integrally joined substantially rigid portion located proximate an integrally joined substantially rigid second portion of said second ring positioned opposite said first portion of said second ring;

(b) a third hinge mounted to hingedly join said fourth ring first portion to said second ring second portion, said third hinge including means to releasably lock said third hinge in selected positions thereby enabling said fourth ring to be held in a vertical position or folded to rest proximate said first, second and third rings; and (c) means joined to said fourth ring providing a support surface thereon.

3. A foldable support structure as claimed in claim 2 wherein said means joined to said second ring providing said support surface serves to provide a seat surface and said means joined to said fourth ring providing a support surface serves to provide a seat back surface.

4. A foldable support structure as claimed in claim 3 wherein said foldable support structure comprises a foldable chair.

5. A foldable support structure as claimed in claim 2 wherein said hinges are adapted to be positioned so as to permit said rings to collapse into a nested relation.

6. A foldable support structure as claimed in claim 5 wherein said first, second, third and fourth annular rings are of substantially the same size thereby enabling said rings when in said nested relation to reside substantially one above the other.

7. A foldable support structure as claimed in claim 1 wherein said means joined to said second ring providing said support surface serves to provide a seat surface.

8. A foldable support structure as claimed in claim 1 wherein said means providing said support surface serves to provide a table surface.

9. A foldable support structure as claimed in claim 8 wherein said foldable support structure comprises a foldable table.

10. A foldable support structure comprising:

(a) a first substantially rigid tube defining in a first plane a first space surrounded by said first tube and formed for service as a base;

(b) a second substantially rigid tube defining in a second plane a second space surrounded by said second tube and formed for service as a load bearing support above said base;

(c) a third substantially rigid tube defining in a third plane a third space surrounded by said third tube and formed for service as a connector to connect said first and second tubes and to support said second tube above said first tube;

(d) a first releasably lockable hinge mounted to hingedly join adjacent portions of said first and third tubes;

(e) a second releasably lockable hinge mounted to hingedly join adjacent portions of said second and third tubes;

(f) said hingedly joined adjacent portions of said first and third tubes being oppositely disposed from the hingedly joined adjacent portions of said second and third tubes; and (g) whereby said first tube when acting as a base and supported on a base surface is enabled to either fixedly support by means of said third tube said second tube in a position above and substantially parallel to said first tube with said first hinge in a first position or when said first tube is not acting as a base and with said first hinge in a second position to be folded to rest adjacent said second and third tubes in corresponding folded positions.

11. A foldable support structure comprising a plurality of annular rings and at least two weight bearing hinges for rotationally receiving said annular rings and holding said rings in fixed load bearing angular positions said hinges comprising:

(a) a hinge body having a partial circumferential slot formed therethrough, two adjacent substantially parallel axial tubular portions, and a hinge brace terminating said slot; wherein one of said annular rings is rotatably received within said one of axial tubular portions, and a second of said annular ring is rotatably received within said second of said axial tubular portions;

(b) a first stop plate permanently attached to said one annular ring and rotatable through said circumferential slot;

(c) a second stop plate permanently attached to said second annular ring and rotatable through said circumferential slot; and (d) wherein when said first and second stop plates rotate in a first selected direction through said circumferential slot to bias against said brace, said foldable support structure rings are in fixed load bearing angular positions, and wherein said first and second said hinges rotate in a second selected direction, said foldable support structure is in a released position.

* * * * *

UNITED STATES PATENT AND TRADEMARK OFFICE

CERTIFICATE OF CORRECTION

PATENT NO. : 5,979,976

DATED : November 9, 1999

INVENTOR(S) : Mark J. Ferencik

Attorney Docket No.: FEMA5001BOTW

It is certified that error appears in the above-identified patent and that said Letters Patent is hereby corrected as shown below:

Column 2, line 35, correct "FIGS. 10A and 10B show" to read --FIG. 10 shows--. (Applicant error)

Column 2, line 36-37, delete "taken along 10-10 as shown in FIG. 9". (Applicant error)

Column 2, line 39, delete "(FIG. 10A)". (Applicant error)

Column 2, line 42, delete "(FIG. 10B)". (Applicant error)

Column 4, line 65, correct "joins" to read --joints--. (Applicant error)

Column 5, line 2, after "44", insert a comma. (Applicant error)

Column 5, line 19, correct "continues" to read --continuous--. (Applicant error)

Column 5, line 39, correct "continues to" to read --continuous--. (Applicant error)

Signed and Sealed this

Thirteenth Day of June, 2000

*Attest:*

*Attesting Officer*

Q. TODD DICKINSON

*Director of Patents and Trademarks*